US009064646B2

(12) United States Patent
Wavering

(10) Patent No.: US 9,064,646 B2
(45) Date of Patent: Jun. 23, 2015

(54) ELECTRICAL SYSTEM LOCK OUT SWITCH

(71) Applicant: Hamilton Sundstrand Corporation, Windsor Locks, CT (US)

(72) Inventor: Jeffrey T. Wavering, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 202 days.

(21) Appl. No.: 13/752,918

(22) Filed: Jan. 29, 2013

(65) Prior Publication Data

US 2014/0209438 A1 Jul. 31, 2014

(51) Int. Cl.

| | |
|---|---|
| ***H01H 9/28*** | (2006.01) |
| *H01H 71/04* | (2006.01) |
| *H01H 71/06* | (2006.01) |
| *H01H 71/58* | (2006.01) |
| *H01H 73/16* | (2006.01) |
| *H01H 9/16* | (2006.01) |
| *H01H 13/14* | (2006.01) |

(52) U.S. Cl.

CPC ..... *H01H 9/286* (2013.01); *H01H 71/04* (2013.01); *H01H 71/06* (2013.01); *H01H 71/58* (2013.01); *H01H 73/16* (2013.01); *H01H 9/16* (2013.01); *H01H 13/14* (2013.01)

(58) Field of Classification Search

CPC ..... H01H 9/283; H01H 71/04; H01H 71/06; H01H 71/58; H01H 83/20; H01H 73/16; H01H 9/286

USPC ..... 200/43.01–43.22, 308, 520, 314, 341

See application file for complete search history.

(56) References Cited

U.S. PATENT DOCUMENTS

| | | | | |
|---|---|---|---|---|
| 3,729,607 | A | 4/1973 | Ellenberger | |
| 5,459,446 | A * | 10/1995 | Vidal et al. | 337/188 |
| 6,639,492 | B1 * | 10/2003 | Hall et al. | 335/6 |
| 6,791,040 | B1 | 9/2004 | Puhalla et al. | |
| 7,570,146 | B2 * | 8/2009 | Mills et al. | 337/101 |
| 2002/0158724 | A1 | 10/2002 | Wellner et al. | |
| 2011/0228509 | A1 | 9/2011 | Steele et al. | |

FOREIGN PATENT DOCUMENTS

| | | |
|---|---|---|
| EP | 1126492 A2 | 8/2001 |

OTHER PUBLICATIONS

Extended European search report for EP application 14153095.6, mailed May 14, 2014, 7 pages.

* cited by examiner

*Primary Examiner* — Edwin A. Leon
(74) *Attorney, Agent, or Firm* — Cantor Colburn LLP

(57) ABSTRACT

An electrical switch for use in an electrical actuation system is provided including a switch box having an upper surface with an opening. A stem guide is coupled to the switch box adjacent the opening. A lock out mechanism is received within a central bore of the stem guide and the opening. The lock out mechanism is configured to move between a first position and a second position to selectively break a flow of power through the electrical switch. A pin is configured to couple the lock out mechanism to the stem guide in one of the first position or the second position.

19 Claims, 3 Drawing Sheets

ELECTRICAL SYSTEM LOCK OUT SWITCH

BACKGROUND OF THE INVENTION

Exemplary embodiments of this invention generally relate to electrical actuation systems and, more particularly, to a lock-out solution for an electrical actuation system of an aircraft.

During installation, service and maintenance of powered equipment, service personnel, such as electricians for example, must assure that the equipment being worked on is isolated from its power source. Although the power source is usually electrical, other power sources such as mechanical, hydraulic, pneumatic, chemical, and thermal may be involved.

When the power source and the equipment are arranged generally at the same location, isolation is not difficult. However, it is common that the power source, e.g. a breaker box, is located relatively far away from the equipment in need of service. Thus, it is possible that after the equipment is isolated at the power source it may be inadvertently powered on by other personnel who do not know that the equipment was intentionally powered off.

"Lock-out" and "Tag-out" refer to safe methods for the complete power isolation of equipment during maintenance or service work. OSHA regulations require the use of locks or tags at control points, such as breaker boxes for example, as warning devices to ensure that personnel are not injured from accidental machine start-ups. While many lock-out and tag-out solutions perform well, none are fool proof. For example, tag-out solutions assume that all personnel can read the same language. Lock-out solutions are often difficult to install and require that the device being locked is pre-equipped with a lock receiving apparatus. In addition, lock-out solutions may be bypassed intentionally or accidentally without the knowledge of the affected personnel.

As aircrafts convert systems previously using hydraulic controls to new electrical solutions, issues arise in preventing unintended start-up of equipment. Many of these systems on an aircraft have large moving surfaces that can create a safety hazard if they were to accidentally move while maintenance personnel are working on them or a neighboring engine. Hydraulic lockout valves were previously used in the hydraulic lines to prevent fluid flow, and therefore movement of these large surfaces. Because these systems are now electrically actuated, an electrical lock out mechanism configured to safely lock out the system by removing power is desired.

BRIEF DESCRIPTION OF THE INVENTION

According to one embodiment of the invention, an electrical switch for use in an electrical actuation system is provided including a switch box having an upper surface with an opening. A stem guide is coupled to the switch box adjacent the opening. A lock out mechanism is received within a central bore of the stem guide and the opening. The lock out mechanism is configured to move between a first position and a second position to selectively break a flow of power through the electrical switch. A pin is configured to couple the lock out mechanism to the stem guide in one of the first position or the second position.

According to another embodiment of the invention, an electrical actuation system of an aircraft is provided including a power feed line configured to supply power to at least one downstream component. An electrical switch is arranged along a portion of the power feed line. The electrical switch includes a switch box having an upper surface with an opening. A stem guide is coupled to the switch box adjacent the opening. A lock out mechanism is received within a central bore of the stem guide and the opening. The lock out mechanism is configured to move between a first position and a second position to selectively break a flow of power in the power feed line. A pin is configured to couple the lock out mechanism to the stem guide in one of the first position or the second position.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
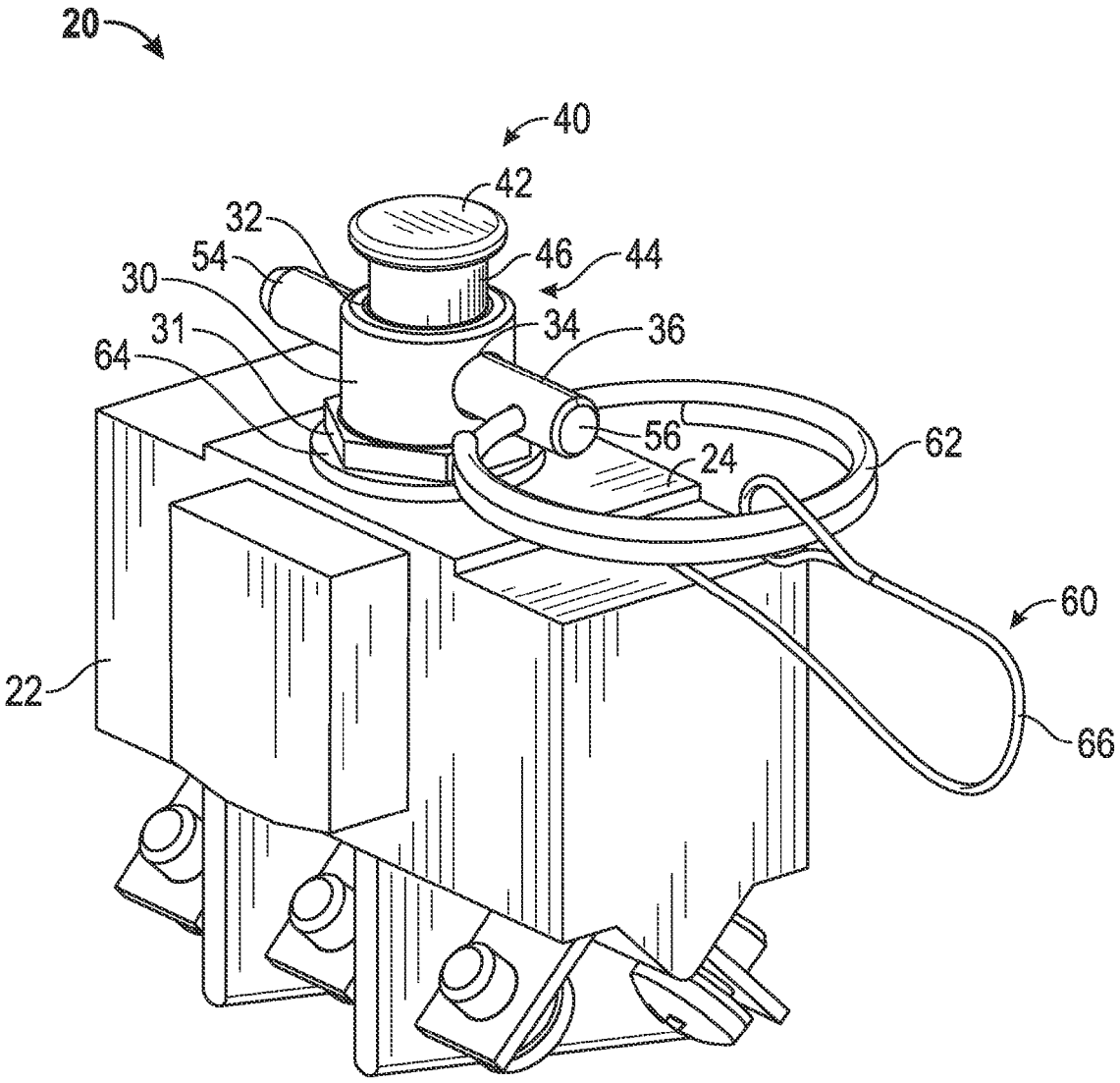
FIG. 1 is a perspective view of an electrical switch in an electrical actuation system of an aircraft according to an embodiment of the invention.

The detailed description explains embodiments of the invention, together with advantages and features, by way of example with reference to the drawings.

DETAILED DESCRIPTION OF THE INVENTION

Referring now to the FIGS., an electrical switch 20, such as from an electrically actuated thrust reverser system or an electrically actuated variable area nozzle system of an aircraft is illustrated. In the illustrated embodiment, the electrical switch 20 is a three pole single throw switch (3PST) having an auxiliary switch for position status. Alternative electrical switches, such as a four pole single throw switch (4PST) that uses the fourth pole for position status for example, are within the scope of the invention. Configured to be mounted to a panel (not shown) in a conventional manner, the electrical switch 20 is arranged within a power feed line of the electrical actuation system and supplies power to a downstream component of the actuation system, such as a motor for example.

A stem guide 30 having a central bore 32 is aligned with and positioned next to an opening (not shown) in the upper surface 24 of the switch box 22. In one embodiment, the stem guide 30 is threadably coupled, such as with a mounting nut 31 for example, to a portion of the switch box 22 extending perpendicularly from the upper surface 24 adjacent the opening. In addition, the stem guide 30 includes a through hole 34 configured to receive a pin 36.

Figure 3:
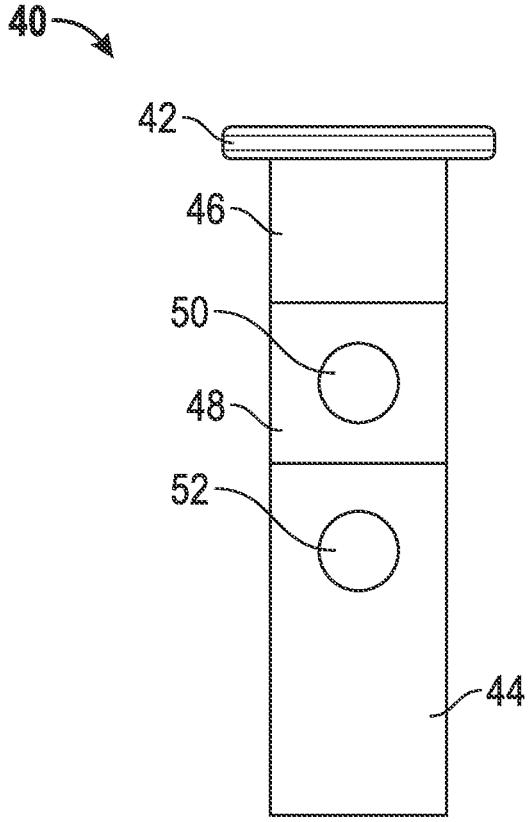
FIG. 3 is a front view of a lock out mechanism of the electrical switch of FIGS. 1 and 2 according to an embodiment of the invention.

The electrical switch 20 additionally includes a lock out mechanism 40 configured to selectively create a break in the power feed line. In the illustrated, non-limiting embodiment, the lock out mechanism 40 is a generally cylindrical stem having a button feature 42 and a shaft 44; however, alternative configuration, such as including a lock out mechanism that pivots for example, are within the scope of the invention. A first portion 46 of the shaft 44, positioned next to the base 42, includes a first color, such as green for example, and an adjacent second portion 48 of the shaft 44 includes a second color, distinct from the first color, for example red. The shaft 44 additionally includes a first through hole 50 and a second through hole 52 (FIG. 3). In one embodiment, the first through hole 50 is arranged within the second portion 48 of the shaft 44, and the second through hole 52 is arranged near the second portion 48 of the shaft 44, opposite the first portion 46. The first through hole 50 and the second through hole 52 may be substantially similar in size to the through hole 34 of the stem guide 30.

The shaft 44 of the lock out mechanism 40 is slidably positioned within the bore 32 of the stem guide 30, as well as the opening in the upper surface 24 of the switch box 22. In the illustrated embodiment, the lock out mechanism 40 is configured to translate about an axis X between a first position (FIG. 1) and a second position (FIG. 2) to alter an operational mode of the electrical switch 20. The shaft 44 of the lock out mechanism 40 is arranged within the bore 32 of the stem guide 30 such that the first and second through holes 50, 52 in the shaft 44 are substantially parallel to the through hole 34 of the stem guide 30. When the lock out mechanism 40 is in either the first position or the second position, one of the first through hole 50 and the second through hole 52 is arranged generally coaxially with the through hole 34 of the stem guide 30.

Figure 4:
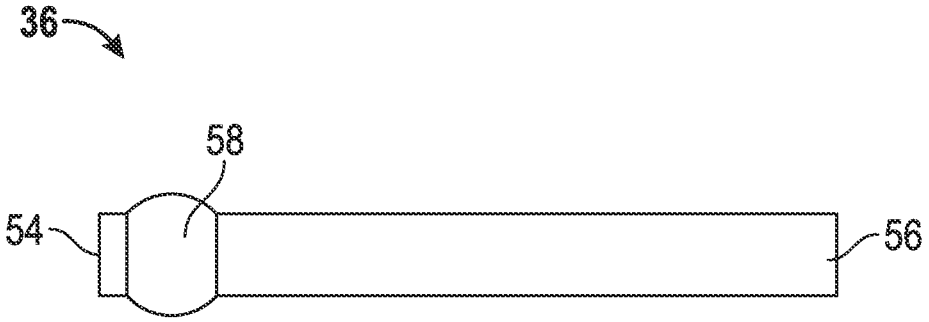
FIG. 4 is a side view of a pin of the electrical switch of FIGS. 1 and 2 according to an embodiment of the invention.

Similar to the through hole 34 of the stem guide 30, the first and second through holes 50 of the lock out mechanism 40 are also configured to receive the pin 36. Therefore, the diameter of the pin 36 is generally smaller than the diameter of each of the through holes 34, 50, 52. The pin 36 is configured to couple the shaft 44 of the lock out mechanism 40 to the stem guide 30 to retain the lock out mechanism 40 in a desired position relative to the switch box 22. In one embodiment, a snap ball 58 is located adjacent a first end 54 of the pin 36 to prevent unintended movement of the pin 36 once inserted through the stem guide 30 and lock out mechanism 40 (FIG. 4). The second end 56 of the pin 36 may be coupled to a retaining assembly 60 configured to limit movement of the pin 36 relative to the switch box 22. The illustrated retaining assembly 60 includes a ring 62 coupled to the second end 56 of the pin 36, and a washer 64 arranged about the lock out mechanism 40, such as between the upper surface 24 of the switch box 22 and the mounting nut 31 for example. A lanyard or cable 66, for example made of stainless steel, couples the ring 62 and the fixed washer 64. A sufficient length of cable 66 is provided such that insertion and removal of the pin 36 from the stem guide 30 and lock out mechanism 40 are not inhibited.

When the lock out mechanism 40 is in the first position, as illustrated in FIG. 1, the pin 36 extends through the hole 34 of the stem guide 30 as well as the aligned first through hole 50 of the shaft 44 of the lock out mechanism 40. In this first position, only the first portion 46 of the shaft 44 having a first color is visible outside the electrical switch 20. In one embodiment, when in the first position, the lock out mechanism 40 indicates that the electrical switch is operating normally and that power from the power feed line is actively flowing through the electrical switch 20 to at least one downstream component.

Figure 2:
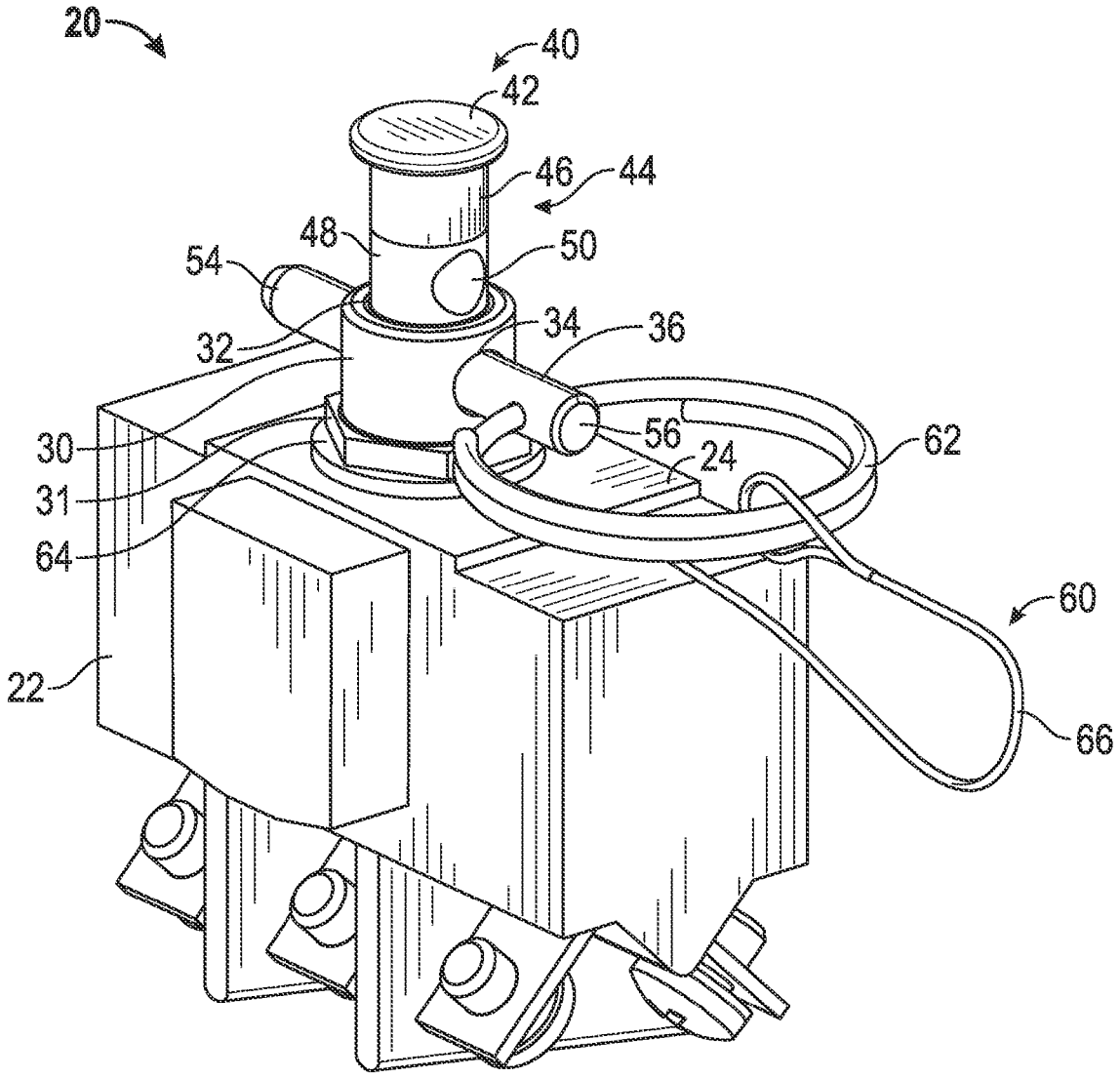
FIG. 2 is a perspective view of an electrical switch in an electrical actuation system of an aircraft according to an embodiment of the invention.

In the second position, as illustrated in FIG. 2, the pin 36 is arranged within the aligned through hole 34 of the stem guide 30 and the second through hole (not shown) of the shaft 44 of the lock out mechanism 40. In the second position, both the first portion 46 and the second portion 48, and therefore the first color and second color of the shaft 44 are visible outside the electrical switch 20. In one embodiment, when in the second position, the lock out mechanism 40 indicates that the electrical switch 20 is in a safety mode and that the power feed line has been broken so that no power is being supplied through the electrical switch to downstream components.

To move the lock out mechanism 40 between the first position and the second position, a mechanic removes the pin 36 from the stem guide 30 and shaft 44 of the lock out mechanism 40 and then applies a force to the lock out mechanism 40. Once reaching the new position, the pin 36 is positively reinserted through the stem guide 30 and the lock out mechanism 40. In one embodiment, a mechanic pulls the lock out mechanism 40 to move the lock out mechanism 40 from the first position to the second position, and pushes the lock out mechanism 40 to move the lock out mechanism 40 from the second position to the first position.

The electrical switch 20 includes an electrical lock out mechanism 40 for use in an electrically actuated system of an aircraft. The color coding of the lock out mechanism 40 will easily indicate to a mechanic if the switch 20 is either in normal mode operation or safety mode operation. By including a snap ball at an end 54 of the pin 36, the pin 36 positively retains the lock out mechanism 40 in a position. The positive locking pin provides a visible locking feature While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An electrical switch for use in an electrical actuation system comprising:

a switch box having an upper surface with an opening;

a stem guide coupled to the switch box adjacent the opening;

a lock out mechanism received within a central bore of the stem guide and the opening configured to move between a first position and a second position to selectively break a flow of power through the electrical switch; and a pin configured to couple the lock out mechanism to the stem guide in one of the first position or the second position, such that when the pin is removably installed into the lock out mechanism, the lock out mechanism is not movable between the first position and the second position.

2. The electrical switch according to claim 1, wherein when the lock out mechanism is in the first position, the electric switch is in a normal mode and when lock our mechanism is in the second position, the electric switch is in a safety mode.

3. The electrical switch according to claim 1, wherein the pin positively retains the lock out mechanism in either the first position of the second position.

4. The electrical switch according to claim 1, wherein the lock out mechanism further comprises:

a button feature; and a shaft extending from the button feature, wherein a portion of the shaft extends through the central bore of the stem guide and the opening in the switch box.

5. The electrical switch according to claim 4, wherein the shaft includes a first through hole and a second through hole spaced apart by a distance.

6. The electrical switch according to claim 5, wherein the shaft includes a first portion next to the base and an adjacent second portion, and the first through hole is arranged within the second portion of the shaft and the second through hole is near the second portion of the shaft, opposite the first portion.

7. The electrical switch according to claim 6, wherein the first portion of the shaft includes a first color and the second portion of the shaft includes a second color, the second color being distinct from the first color.

8. The electrical switch according to claim 7, wherein when the lock out mechanism is in the first position, the first portion of the shaft is visible outside the electrical switch to indicate that the electric switch is in a first mode, and when the lock out mechanism is in the second position, the second portion of the shaft is visible outside the electrical switch to indicate to the electrical switch is in a second mode.

9. The electrical switch according to claim 5, wherein the stem guide includes a hole for receiving the pin.

10. The electrical switch according to claim 9, wherein when the lock out mechanism is in the first position, the first through hole of the shaft is generally aligned coaxially with the hole in the stem guide, and when the lock out mechanism is in the second position, the second through hole of the shaft is generally aligned coaxially with the hole in the stem guide.

11. The electrical switch according to claim 3, wherein the pin includes a snap ball adjacent a first end.

12. The electrical switch according to claim 3, wherein the pin is coupled to the switch box through a retaining assembly.

13. The electrical switch according to claim 12, wherein the retaining assembly further comprises:

a ring coupled to a second end of the pin;

a washer arranged about the lock out mechanism and adjacent the upper surface of the switch box; and a lanyard extending between the ring and the washer.

14. The electrical switch according to claim 13, wherein the lanyard has a length that does not inhibit insertion or removal of the pin from the stem guide and the lock out mechanism.

15. An electrical actuation system of an aircraft comprising:

a power feed line configured to supply power to at least one downstream component; and an electrical switch arranged along a portion of the power feed line including:

a switch box having an upper surface with an opening;

a stem guide coupled to the switch box adjacent the opening;

a lock out mechanism received within a central bore of the stem guide and the opening configured to move between a first position and a second position to selectively break a flow of power through the power feed line; and a pin configured to couple the lock out mechanism to the stem guide in one of the first position or the second position such that when the pin is removably installed into the lock out mechanism, the lock out mechanism is not movable between the first position and the second position.

16. The electrical actuation system according to claim 15, wherein when the lock out mechanism is in the first position, the electric switch is in a normal operation mode and when the lock out mechanism is in the second position, the electric switch is in a safety mode such that power does not flow through the power feed line to a downstream component.

17. The electrical actuation system according to claim 16, wherein when the lock out mechanism is in the first position, the electric switch is in a normal operation mode and when the lock out mechanism is in the second position, the electric switch is in a safety mode such that power does not flow through the power feed line to a downstream component.

18. The electrical actuation system according to claim 17, wherein the first visual indicator is a first color and the second visual indicator is a second color, and the first color and the second color are distinct.

19. The electrical actuation system according to claim 15, wherein the pin positively retains the lock out mechanism in either the first position of the second position.

* * * * *